United States Patent [19]

Schnebly

[11] Patent Number: 4,934,436

[45] Date of Patent: Jun. 19, 1990

[54] SUSPENSION AND ACTUATION SYSTEM FOR SPECIALTY WINDOW SHADES

[75] Inventor: John T. Schnebly, Rensselaer, N.Y.

[73] Assignee: Comfortex Corporation, Cohoes, N.Y.

[21] Appl. No.: 374,473

[22] Filed: Jun. 30, 1989

[51] Int. Cl.[5] ..... E06B 3/94

[52] U.S. Cl. ..... 160/84.1; 160/134; 160/279

[58] Field of Search ..... 160/84.1, 279, 134, 160/168.1, 330, 167, 172, 321, 322

[56] References Cited

U.S. PATENT DOCUMENTS

| | | | |
|---|---|---|---|
| 451,068 | 4/1891 | Park | 160/84.1 |
| 1,609,877 | 12/1926 | Kendall | 160/134 X |
| 2,567,528 | 9/1951 | Rosenthal | 160/35 X |
| 3,386,106 | 6/1968 | Clemens | 160/84.1 X |
| 3,465,806 | 9/1969 | Sulkes | 160/84.1 |
| 3,495,606 | 2/1970 | Phillips . | |
| 4,473,101 | 9/1984 | Langeler . | |
| 4,518,025 | 5/1985 | Judkins | 160/84.1 |
| 4,557,309 | 12/1985 | Judkins . | |
| 4,647,488 | 3/1987 | Schnebly et al. | 160/84.1 X |
| 4,673,018 | 6/1987 | Judkins | 160/84.1 |
| 4,687,038 | 8/1987 | Clemente | 160/84.1 |
| 4,733,711 | 3/1988 | Schon | 160/84.1 |
| 4,739,815 | 4/1988 | Altman | 160/84.1 |
| 4,745,960 | 5/1988 | Karp | 160/84.1 |
| 4,762,159 | 8/1988 | Ford | 160/84.1 |
| 4,799,524 | 1/1989 | Guermonprez | 160/84.1 |

FOREIGN PATENT DOCUMENTS

| | | | |
|---|---|---|---|
| 0240065 | 10/1987 | European Pat. Off. | 160/84.1 |
| 565330 | 7/1960 | France | 160/134 |

*Primary Examiner*—David M. Purol

*Attorney, Agent, or Firm*—Schmeiser, Morelle & Watts

[57] ABSTRACT

Manual deployment apparatus for speciality, pleated or multi-cellular window covering treatments including uniquely hinged mounting rails and single and/or continuous strand pull cords. The invention consists of apparatus that is used to acquire two modes of pleated or multi-cellular shade fabric deployment over generally curvilinear window openings, but particulary over window openings having circular and segmented shapes. A translational deployment, known as the "Blossom Mode" moves a sculptured shade from its rest position by actuation of a continuous cord that is under constant tension. The shade may be deployed to any extent from the mere movement from the completely stowed position to the fully extended. The second modality, known as the "Fan Mode" contemplates deployment of the multi-cellular shade by commencing with the stowed shade marginally secured between a pair of superimposed, and hingably connected rails. Pivoting on the hinges, a special dual hinge arrangement, the non-fixed rail is radially actuated, that is, rotated about the dual hinge mechanism, until the shade fans out over the area of desired coverage. Alternate methods of extension or retraction are provided; and, certain "gap-filler" mechanisms of festoon character are suggested.

8 Claims, 3 Drawing Sheets

SUSPENSION AND ACTUATION SYSTEM FOR SPECIALTY WINDOW SHADES

BACKGROUND OF THE INVENTION

1. Field of the Invention

This invention relates generally to shade deployment and retraction apparatus and specifically to suspension and actuation apparatus for suspending, deploying and retracting shades or curtains that have been specially produced to cover or otherwise enshroud openings of unusual and often unconventional shape.

Of particular interest to the instant inventor is the field of art that deals with tensioned pulley systems, spacer or spacing suspensions, cord or lanyard attachment means and means that are used for snubbing or otherwise securing cords or single strands that are used to motivate basic shade or curtain apparatus.

2. Discussion of the Prior Art

An examination of the background or prior art is best appreciated after the reader is given some insight into the nature of the instant invention and its application with special materials in a specialized environment. With the advent of multi-cellular, essentially planar curtains, the aforementioned suspension, actuation, etc. systems could be developed in embodiments, and for use in environments, that were formerly unavailable to the traditional or more conventional window treatment art such as shades, curtains and window/door/portal coverings. It is because of the fact that the apparatus of the instant invention was inapplicable to window treatment apparatus that employed only planar shades, pleated curtains, or Venetian blinds that exhaustive searches of the prior art and catalogue literature disclosed no relevant disclosures of the instant invention. For this reason, it was necessary to review patents which deal with actuating and suspension mechanisms for window coverings, and the like, and which embody pleats, multiple slats and multi-cellular shade elements.

The instant invention's focus on the usage of pleated or multi-cellular shade material or fabric is, indeed, the rationale for its development in the first place. An understanding, not so much of the physical principles that make multi-cellular fabric so useful, but of its inherent handling and deployment characteristics is necessary to the full appreciation for the aforesaid rationale. To illustrate, by way of contrast, consider the ordinary window shade which consists of a spring biased roller upon which a flat, rectangular fabric is rolled, a rigidified margin at the "pulling" edge of the shade and (usually) a drawstring or finger hoop located either at the middle of the rigid margin or a plurality thereof, individually equally spaced along the margin. Irrespective of the manner in which the multiple drawstrings are ganged (drawn together), the reason for their physical embodiment, whether the single-center type or the plural, periodically-spaced type, the drawing selection mode depends entirely upon the physical embodiment of the shade. The single-central draw cannot be used if the rigid margin to which it is centrally attached is missing, because the shade material is completely flexible and will not draw evenly, whether the draw be upward/downward or transversal. If then, the flat flexible planar shade were cut so as to fill an unusually shaped window, say one of hemispherical cross section, and the hemispherical shade were rolled on a spring biased roller with a draw located at the zenith of the hemisphere and drawn upward, we would have an entirely different case. That particular concept, save for the instant invention, does not appear in the art. Excepted in small part from the previous statement is the patent issued to Phillips in 1970 (U.S. Pat. No. 3,495,606) relating to a Damper Valve for Ventilating Ducts. Phillips, for obvious reasons, did not employ a non-rigid shade fabric that could be drawn from a diametrical cord to a peripheral boundary along an orthogonal radian of this duct. Instead, he chose to use a rigid, pleated diaphragm which expands and retracts over the opening of the duct. The deployment and collapse of the damper member is effected along a fixed diametrical, elongate strut which is connected at each of its ends to diametrically opposed lands in the collar of the duct. During normal operation, the Phillips damper is restrained in a collapsed or undeployed configuration until the melting of a fusible link that has been placed strategically in position to both restrain damper closure, yet sense the excessive heat that will cause it to fuse. Immediately upon fusing of the link, natural resiliency of the damper member urges its constituent hemispherical components toward the closed position; and, retraction therefrom is effected only by physically forging the damper elements back to the collapsed, damper-open position and reinstalling therewith a new fusible link. For several reasons which are intuitively obvious, the fusible link-controlled damper valve of Phillips, although illustrative of the pleated curtain usage for the covering of circular or semicircular openings, bears no true relevance to the suspension and actuation means of the instant invention.

At this point, discussion has been relegated to the coverage of radiating openings by movable shade apparatus wherein the movement is essentially translational, that is, straight across a radian, diameter or chord of the curvilinear opening. There exist four pieces of prior art that are deemed by the instant inventor to be germane to the subject of radiating curtains or shades and the installation, supporting and/or actuation mechanisms therefor. The earliest of this art form is exemplified by U.S. Pat. No. 1,609,877 issued to Kendal in December 1926 for a Circle Head Window Shade. In June 1968, Clemens was issued U.S. Pat. No. 3,386,106 for a Shower Curtain Structure; while Karp was issued U.S. Pat. No. 4,745,960 in May 1988 for a Collapsible Partition Assembly. Finally, in this class of art, European Patent Application No. 8720517.8, Publication No. 0 240 065, was filed on Mar. 20, 1987 for a Folding Curtain Screen Structure for a Triangular Window.

Kendal discloses installation apparatus for a collapsible, pleated semicircular shade which deploys radially from a collapsed position occupying a single radian through an arcuate path to full deployment of a semicircular pattern. In one embodiment Kendal attaches the semi-circular pleated shade to a rigid sill passing two hoops, one through the pleats of the shade proximate its center, and the other adjacent the pleat crests, near the circumferential perimeter thereof. In this embodiment, the central hoop, which is used to guide and sustain the arcuate deployment of the shade, passes through the shade elements proper and is common to all embodiments taught by Kendal. The outer or circumferential hoop which is used to sustain not only the deployment of the shade, but maintain its rigidity along the peripheral shape of the opening, may be placed through the shade elements proper as is the central or root hoop; or it may be captured by loops or clevises that are secured to the crests of the pleated elements. Again, it is intuitive that, because Kendal works with a fabric that is essentially planar and flexible (albeit pleated), he cannot dispense with the outer peripheral hoop; and thus, must resign himself to the use of suspension and actuation mechanisms, and apparatus, that remain visible when the shade is collapsed, thus presenting to the viewer a totally non-aesthetic and unappealing vision. Because the instant inventor employs a pleated or multi-cellular fabric, which is inherently more rigid than planar fabric, it is possible to dispense with the support hoops and attendant deployment apparatus of Kendal and create a resultant product that is aesthetically far more appealing.

In the patent issued to Clemens for a Shower Curtain Structure, a collapsible, pleated shade is seen to effect, upon deployment, a quarter circle shape. The pleated shade material is affixed at each radial margin to a flange element and both flange elements are pivotally connected at the center point or radial point of the curtain structure. For all intents and purposes, the hinge is conventional and otherwise not noteworthy. Installation of the Clemens Curtain is had by affixing one radial flange to a vertical surface and thereafter deployed by disconnecting the free end of the other radial flange from its engagement with the wall-mounted flange and "fanning" the curtain radially as the moving flange transits a downward arcuate path. Collapse or stowage of the deployed shade is effected manually by moving the pivotable flange member back into locked registry with the wall-affixed flange element. Although having, perhaps, some utility in the window treatment area, as envisioned by the instant inventor, Clemens nonetheless made no suggestion therefor nor did he suggest a collapse or retraction means for the deployed shade or curtain of this invention. In a situation where a specially designed window, requiring a quarter-round geometry for its respective shade covering is located well above the average head height, the manual stowage and lock-/unlock feature of Clemens is completely deficient. Peculiar to the aforementioned circumstance, the instant invention provides an excellent solution to the problem.

In some respects similar to the Clemens invention, Karp teaches the deployment of a pleated shade by the movement of a hinged member through an arcuate path of approximately 90° A uniquely pleated curtain is disclosed by Karp in order to effect one embodiment of his invention that requires an arcuate deployment of an apparently rectangular fabric. However, the type of shade employed by Karp is not germane while the means of deployment and retraction bear some relevancy. Succinctly, Karp "lowers" the movable flange element to which one margin of the curtain is affixed. Lowering of the movable flange element is accomplished through use of a winch-type apparatus located at the top of the fixed marginal element through a chord running therefrom to the outer end of the movable margin element. Clearly, the winch apparatus of Karp is totally inapplicable to the needs of the instant inventor and has no more utility than the Clemens closure method.

The European patent application of Niemeijer discloses a novel screen structure for covering a non-rectangular window. Although in some respects relevant, Niemeijer, apparently lacking the pleated or multi-cellular shade fabric used by the instant inventor, has no incentive to utilize the instant invention's apparatus as will be hereinafter disclosed. Instead, Niemeijer employs a distinctive screen structure comprised of overlapping shade segments that are interlinked by a plurality of common cord strands. The strands pass through practically all segments along common locii and are used to gather the shade (quite cleverly) upward to the shade's fixed radial margin. Although the instant invention contemplates, or at the least Would provide a solution to the screening of a triangular shaped WindoW, the method of Niemeijer Would be totally inapplicable to the problem solution in the intended environment simply because it makes no attempt to solve the problem using the preferred shade or fabric embodiment of the instant inventor nor, more importantly, deal with curvilinear opening geometries, in general. Relative to actuation devices for generally arcuate, and specifically arch topped shades, apparatus employed by two contemporary inventors appears to be the most relevant. Langeler Was issued U.S. Pat. No. 4,473,101 in September 1984 for an apparatus entitled Sun Blind. In December 1985, Judkins was issued U.S. Pat. No. 4,557,309 for a Sun Blind and again, in June 1987 U.S. Pat. No. 4,673,018 for an invention bearing the same title. Although neither of these inventors was concerned with the immediate problem, that of deploying and retracting, as well as fixing between the fully retracted and fully deployed positions a sun screen or curtain made of pleated or multi-cellular fabric, it is nevertheless incumbent upon the instant inventor to discuss certain aspects of these relevant patents because it is evident that they were concerned not so much with the overall appearance of their respective inventions (perhaps to some degree because they look alike), but rather to the method and means for actuating and guiding the shade element therein.

Langeler teaches a sun blind which comprises a horizontal upper bar, serving also as the header of a window frame, and a horizontal bar disposed for movement with respect to the top bar, with lateral guides for guiding the ends of the movable bottom bar. The lateral guides reside within the side posts of the window frame. At least two cords are used to guide the bottom bar while the ends of the cords are fastened to fixed points of either the top bar, the bottom bar or the lateral guides of the apparatus. Notably, Langeler utilizes a plurality of spring tensioners in the form of coil springs to provide tension on the aforesaid cords and locates the individual spring at the end of the cord where it is attached to either the header or sill elements, or the lateral guide bars. The Langeler actuation mechanism, although capable of positioning the curtain, requires a plurality of cords for such positioning. Secondly, it is evident that the purpose of the springs attached at the end of each cord is primarily to prevent overstressing or breakage of the cord upon overloading and, secondarily, for tensioning the cord. Neither the apparatus for deployment nor the cord actuation system of Langeler would function in, nor is it addressed to, the requirements of the instant inventor in providing single point attachment mechanisms for his novel window treatment designs.

Similar to Langeler, Judkins teaches the use of two or more cords, one to support the shade at an angle off the vertical, and the other to move the shade upWards by movement of a cord set (the shade is lowered by gravity). In contrast to the art of both Langeler and Judkins, the instant invention does not rely operationally on gravity (a reliance which may result in damage to either the shade fabric or sills), but is actuated by use of a tension cord. Further, actuation directions may be either vertical or horiZontal. This versatility is acquired through the use of a solitary cord, a nuance which appears both noVel and, since it has not appeared in patents issued as late as 1987 in the shade art, not obvious. Further, from a careful study of all the prior art, it appears that none of the inVentors of the herein-discussed relevant art had any motiVation to actuate a curvilinear shade at but a single point. Although the teachings of Karp (infra.) did contemplate a single cord retraction, Karp evidently did not feel impelled to practice the instant invention, nor suggest same, because he was totally satisfied With his winch-type retraction mechanism.

Having found no solace in the offerings of other inventors regarding to their inculcation of shade or curtain installation, suspension and/or actuation mechanisms, the instant inventor felt compelled to devise his own mechanisms to serve his specific needs. The resultant invention, hereinafter both summarized and described in enabling detail, rightfully and properly takes its place in the vanguard of mechanisms used in the operation of specially designed WindoW treatments. They are as unique and essential as are the multi-cellular fabric structures that they serve to functionalize.

SUMMARY OF THE INVENTION

The instant inventor contemplates herein two actuation mechanisms for deployment of a pleated or multi-cellular shade product over (generally) a curvilinear opening or, more specifically an arched window having either a quarter-circle or half-circle geometry.

Fundamental to the instant invention is the multi-cellular shade product which, when deployed, bears strong resemblance to the festoons often seen during holiday seasons. When such a pleated or multi-cellular fabric is employed to afford aesthetic window treatments however, the decorator cannot rely upon antiquated methods of attachment, deployment, and stowage of the principal window dressing fabric.

Relative to the attachment (or installation), deployment and stowage apparatus, which shall hereinafter be referred to as operational equipment, specific elements of the invention comprise hinged rail installation devices, and single strand cord mechanisms formed, when operationally prudent, into continuous (loop) configuration. When operational requirements dictate, spring tensioners are employed to maintain tension on the cord, and thereby on the deployed shade fabric so as to maintain it in any desired position ranging from the fully stowed to the fully deployed.

At least one rail is employed in any mode of installation because it is necessary to rigidly fix a base margin of the multi-cellular fabric. In gross, this practice is also followed in the festoon art, because such "hemming" readily facilitates the expansion and fixation of a pleated or multi-cellular fabric. The marginal rails employed in the instant invention, in the singular aspect, are elongate rectangular struts which are mountable flush to a flat surface, such as the header, sill or other mounting surfaces of a window or door frame. Although the shade may be constructed to accommodate most any curvilinear opening, there exists a singular requisite of at least one flat surface, from which the shade is deployed and stowed. In other installation modes, the alternate usage of the rail is made wherein a dual articulable hinge is used to join two rails, endwise, so that upon deployment, the rails may be in 180° registry, be collapsible to any degree of arc between 0 and 180°, and be finally stowable with one rail hingably connected, but superimposed above the other with the pleated or multi-cellular fabric of the shade collapsed therebetween.

Actuating cordage of the instant invention is employed in two modes: the first using a continuous singular strand or cord on which a continuous tension is maintained, thus obviating the use of snubbing or stopping apparatus; and a single strand embodiment which employs snubber or stopper arrangements that are generally employed more for functionality than for aesthetic reasons.

After the reader has had the opportunity to view the Detailed Description of the Preferred Embodiment in conjunction with the drawings, a greater appreciation will be gained for the utility and novelty of this invention. Until this time, most multi-cellular shades or curtains were deployed manually. Further, and far more limiting to the utility of the novel fabrics, was their confined usage to the covering of only rectangular openings. The various mechanisms disclosed herein therefore, fulfill a long-felt need in this art area and in the industry as a whole.

BRIEF DESCRIPTION OF THE DRAWINGS

Of the Drawings:

FIGS. 3A1, 3A2 and 3A3 are an orthographic illustration of the dual articulable hinge apparatus of the invention;

DETAILED DESCRIPTION OF THE PREFERRED EMBODIMENT

Before beginning a detailed exposition of the invention it should be called to the reader's attention that the instant apparatus is often employed combinationally; however, there are instances where, for the purposes of economy, convenience or mere expedient, that only one or two facets of the invention are used. In order to clarify which elements of the preferred embodiment are applicable in a particular situation, the instant inventor will hereinafter refer to two basic modalities of shade usage: the first being that which was first described in this paper wherein the pleated or multi-cellular fabric is preshaped or sculptured and expands generally orthogonally from its marginal base, hereinafter termed the "blossom mode"; and alternatively, where one margin of the multi-cellular fabric is fixed, while a separate margin (generally, but not always articulatively hinged) is caused to radially deploy, hereinafter termed the "fan mode". Depending upon whether the blossom or fan mode of shade deployment is employed, there will be differing uses, or combinations, of hinges, cords, snubbers/stoppers, etc.

Figure 1:
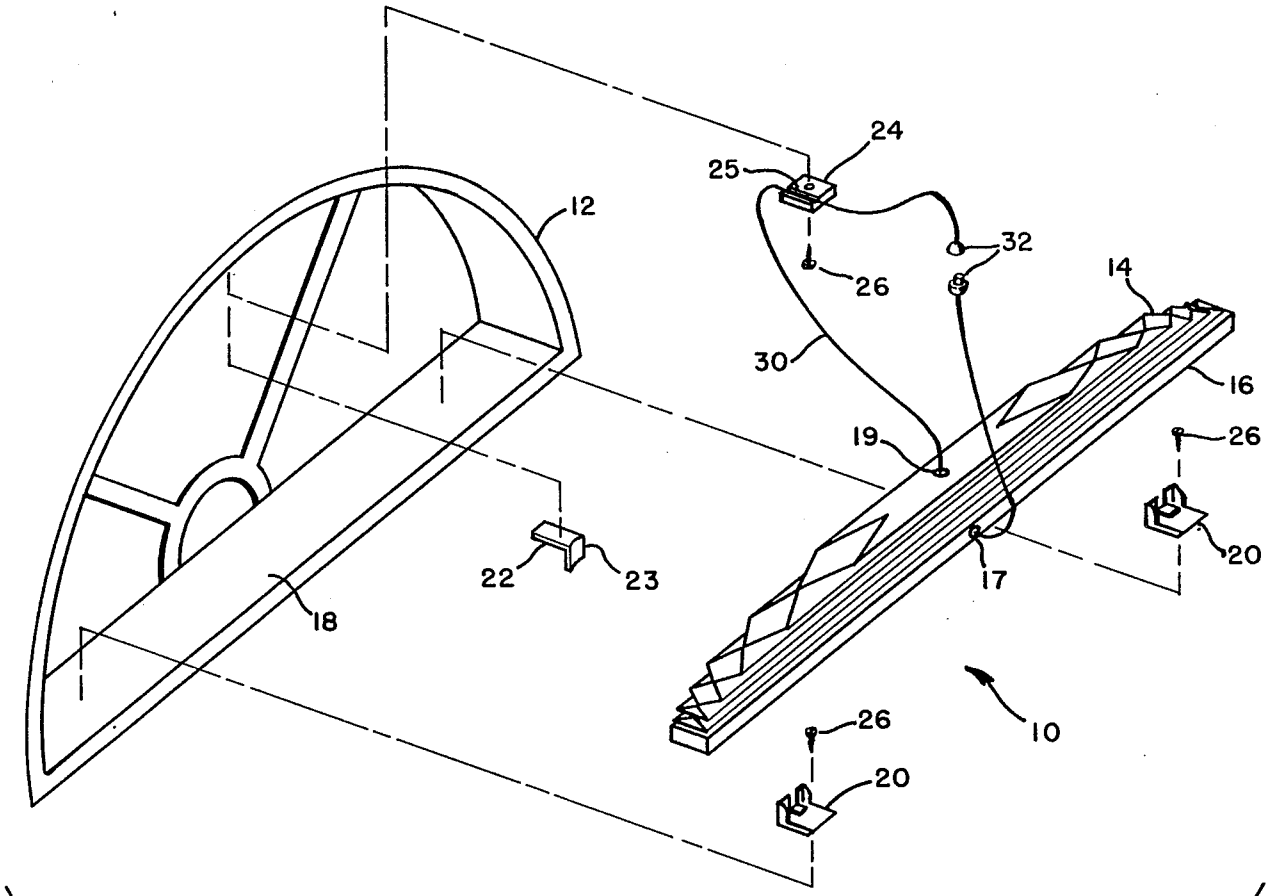
FIG. 1 is an isometric installation illustration of the invention.

Particularly referring to FIG. 1, a pleated or multi-cellular shade 10 is disposed for installation into a semi-circular transom 12 in the blossom mode. Here, it may be seen what is meant by blossom mode, as described above, wherein the shade 10 comprises a sculptured embodiment of the pleated or multi-cellular fabric 14 fixed to (by conventional means) and marginally fixed to an elongate rail 16. Also disposed for placement at the base 18 of the transom 12 is a pair of rail brackets 20 which are used to engage a laterally grooved portion of the rail 16. Once the curtain ensemble is installed at the base or sill of the transom, deployment hardWare such as the L bracket 22 or the top block 24 is installed. Generally, the L bracket 22, a bracket having a col or saddle-shaped short leg 23, is generally employed in the fan mode setup. The top block 24 is always used in the blossom mode setup, an arrangement that will at least tolerate use of the L bracket, if not using it to hold, then to hide the exposed margins of the top block. The exposed col portion 23 of the L bracket may be used to affix some form of decoration and therefore is likely to be found in both modes of shade usage. Most of the aforesaid fixing apparatus is secured by screws 26 as shoWn in FIG. 1. Final to the illustrated embodiment, the actuation cord 30 is seen passing through the central portion of the rail 16 at port 17. Thereafter, it is rigged internally to a tensioning mechanism (not shown) and passes through the shade fabric 14, exiting at the zenith port 19, to be passed next to the backside of the now mounted top block 24, residing in groove 25 and exiting thereafter from the groove, out the front side of the top block. Thereafter, cord 30 is properly tensioned, by means of the internal tensioning mechanism (not shown), and the ends are trimmed and secured to each other by appropriate mechanisms such as the illustrated screw-mating joiner ball 32.

Figure 2:
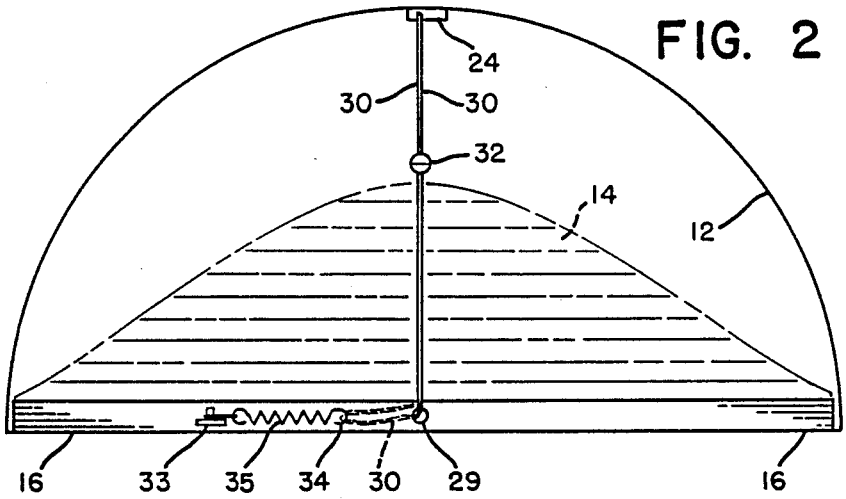
FIG. 2 is an elevational partial schematic of the FIG. 1 embodiment.

In the elevational schematic of FIG. 2, the blossom mode usage of FIG. 1 is stylistically illustrated so that the reader may appreciate the aforementioned tensioning mechanism. The marginal rail 16 is depicted installed in the transom 12, devoid of pleated or multi-cellular fabric 14. Cord 30 is depicted in its installed and tensioned position, and joiner ball 32 has been omitted for the sake of clarity. Cord 30, passing through top block 24 is directed downward through eyelet 29 of marginal rail 16. Thereafter, the cord, comprising at this juncture a continuous strand is directed orthogonally inside of the rail to ring 34. Ring 34 is attached to coil spring 35 which is anchored inside of the rail to a button anchor 33. When properly installed, according to the installational directions given during the disclosure of FIG. 1, a proper tension may be maintained on the cord 30 at all times, irrespective of the shade position. Thus, in the blossom mode the shade fabric of the invention may be seen to rise from the transom sill 18 much like a blossom opening or a bubble expanding. The window covering may be complete, or partial, and because of the tensioned actuating mechanism, may be maintained static at any point in its deployment or retraction.

Those of ordinary skill will recognize that in the blossom mode of employment the decorator is not constrained to the express embodiment shown herein. Rather, employing his or her knowledge and skill, it is possible to cover varied curvilinear geometries merely by sculpting the shade fabric to the desired final shape and using whatever number of cords are required for actuation and overall operation of the particular window treatment. Also, such skilled persons may readily recognize that a singular piece of fabric need not be used; but rather, the overall curvilinear structure may be partitioned and, whether from a single base margin or multiple margins (rails), the partitioned sections may be discretely actuated by their respective cords.

In some cases, with some types of pleated or multi-cellular fabrics, a stiffener rod is inserted to assure that upon collapse of the shade, the extended fabric fully closes to a compact and pleasing pile of uniform folds.

Figure 3B:
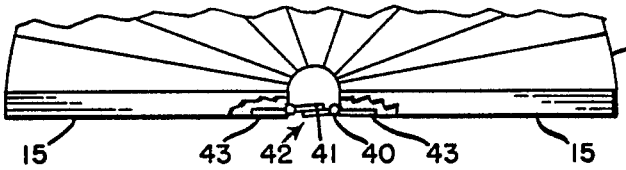
FIG. 3B is the apparatus of FIG. 3A in the stowed position.
Figure 3B:
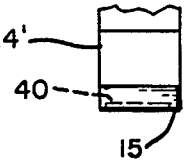
Figure 3B:
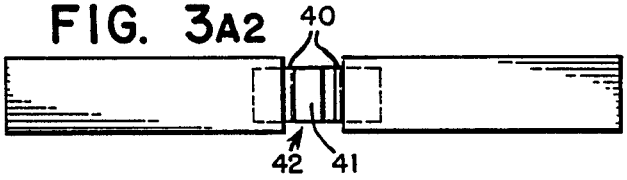
Figure 3B:
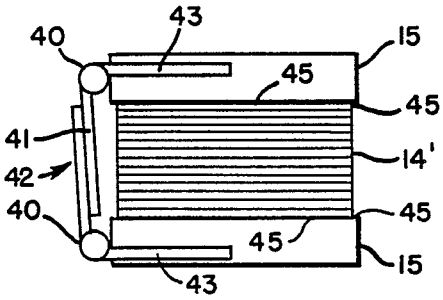
Figure 3C:
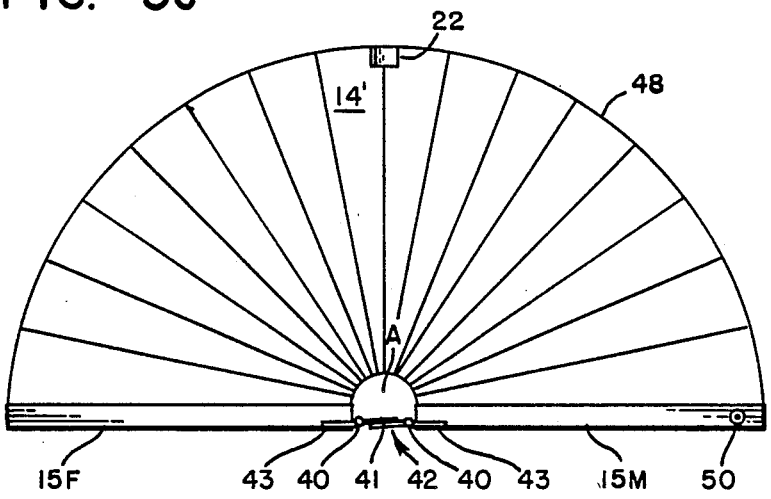
FIG. 3C is an elevational schematic of a shade embodiment used with the invention.

The fan mode, of course,,makes use of the same pleated or multi-cellular fabric, but employs certain elements that are necessary in order to achieve the particular modality. The hereinafter identified elements, in reality, serve a dual purpose; they aid enormously in the installation of the invention and allow the acquisition of the particular aesthetic properties of a shade that is expanded radially rather than orthogonally from a radial base or diametrical base. Referring now more particularly to FIGS. 3A–3C, there are depicted therein the salient elements essential to the employment of the fan mode embodiment of the instant invention. FIGS. 3A1–3A3 are an orthographic illustration of the dual rail and hinge apparatus that is used to acquire a sector/sectional window or port covering. In this embodiment, a pair of rails 15 are employed and are held in hingable registry with each other by use of the therein depicted hinge mechanism. As may be seen from the side elevational view, the hinge mechanism is comprised of two hinges 40 with their respective hinge plates 41, 43. Unlike normal hinge mechanisms however, a hinge plate 41 from each of the hinges is adjoined to each other 42 by one of several known means, such as welding, braising, cementing etc. The axis of joinder is aligned with the rails 15 and the remaining, unjoined hinge plates 43 are securely affixed to each of the rails. Thus, the hinge axis of extension is also colinear to the longitudinal axis passing through each of the rails 15. Those of ordinary skill will readily surmise that plate/junction 41, 42, 41 can be realized by a single plate (having a hinge 40 at each end). The displayed embodiment is merely an expedient. In the FIG. 3B illustration, the FIG. 3A apparatus is seen articulated so that one rail 15 is superimposed on the other and the radially deployable pleated or multi-cellular fabric 14' is disposed therebetween, securely affixed to the rails along shade margins 45. It is in FIG. 3B that the reader may clearly observe the use of the dual hinge apparatus and thereby understand the rational basis for this teaching.

Reference being had to FIG. 3C, the invention is therein exhibited in the fully deployed fan mode and lacks only the finishing touch of a decorative facade to cover the space A that exists at the radial center of the shade because of the absence of shade material directly above the joint network. The reader should understand that FIG. 3C is highly stylized and somewhat exaggerated, as the general dimension of space A is most often less than a few square inches and, for all practical purposes, the facade erected to cover the space is well within the purview of the modern decorator. It may be also readily seen, in FIG. 3C, that the L bracket 22 now provides more than a mere facade or cloaking function for the top block 24 (not used in this embodiment). The bracket 22 is used to prevent the fanned-out fabric 14' from falling forward in the transom. Should the transom be sufficiently deep, so as to invite an inward (or backward) falling of the fabric, an additional L bracket 22 may be mounted and aligned coextensively over and with the depicted bracket. This will have the effect of forming a short channel, at the zenith of the transom arch, into which the peripheral margin of the shade 48 will pass. It is also likely, depending upon the weight and texture of the shade material, that more than a single or pair of L brackets 22 may be used. It is noteworthy that in this embodiment, the fan-mode apparatus actually depicted in FIG. 3C, no pretense is made for the use of cords or other actuating mechanisms. Unless the transom is exceedingly high, it is sufficient to deploy the shade by manually urging rail knob 50 in an arcuate (circular) direction to the full open position bringing rail 15M into the position shown. The shade will remain deployed, held so by the weight of the moved rail 15M. Even under conditions of an exceedingly high transom, rail 15M may be rotated into the deployed position by use of a pole having eyelet, ring or loop means at the end thereof.

Figure 4:
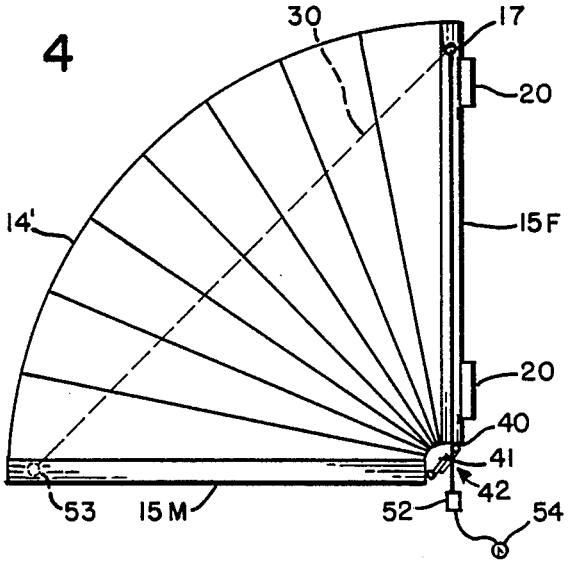
FIG. 4 is an elevational schematic of the FIGS. 3A–3B embodiment in an alternate employment mode.

In situations where it is desirable to deploy the fan mode embodiment over an opening having less of a span than the semi-circle, great utility is acquired through use of the fan mode installation of FIG. 4. The reader should understand that this is a nominal installation only and that the technique employed here, though generalized, may be readily extrapolated for covering windows or openings having a radial span from less than one, to two (2) pi radians. In other words, if one can mount one of the rails 15 along any radian of a circle, it is possible to radially deploy a curtain in the fan mode 360° so as to move the movable rail 15M around the pivot, bringing it back into contact with the fixed radian base. Such a usage would, however, seem somewhat ludicrous and, in a situation calling for a circular covering, the blossom mode would be much more effective. Nevertheless, the example serves to illustrate the versatility of the fan mode embodiment and further proves that the illustration of FIG. 4 is indeed a nominal configuration. In FIG. 4, fixed rail 15M is vertically mounted to a frame edge by brackets 20. Were movable rail 15M allowed to descend by gravity, it would assume the position shown in FIG. 4 and be held in that configuration, as in FIG. 3C by the mass of rail 15M. For the sake of convenience and ease of operation however, the instant inventor teaches the usage of a single strand 30 that is fixed at a point 53 on the backside of movable rail 15M, passed angularly upward to an eyelet (not shown) at the backside of fixed rail 15F, transversely through rail 16F exiting at eyelet 17, and down the frontside of 15F through a snubbing device 52, terminating at tassel 54. To retract the shade, the operator pulls chord 30 by grasping at tassel 54 and drawing along a line essentially parallel to fixed rail 15F. A snubber 52 is fixed at a suitable location for access and ease of operator manipulation, and is of a type well known to those of ordinary skill in both the shade industry and decorator field. Relative to snubber usage, the more favored type used by the instant inventor is the spring-biased cord compression or lever type of snubber.

The rudiments only of the instant invention have been disclosed herein because it is realized that those of ordinary skill will apply their experience and know how in order to achieve the results and specific advantages gained through the practiced use of the instant invention. The instant inventor choses to cover the spaces resulting at the radial center of the fan mode embodiment with a festoon made in the same style as the pleated or multi-cellular fabric shade 14'. The festoon comprises a relatively short width of the multi-cellular fabric, either identical to that of the shade or otherwise size and color compatible with it, which is fanned out or radially expanded and marginally fixed in front of the hole or space which is to be covered. Again, other decorators will certainly have other ideas for acquiring the space-covering element(s); that of the instant inventor is commended to them for such particular usage. The concepts, apparatus and particular elements disclosed herein notwithstanding, the instant inventor secures to himself only that body of art encompassed by the hereinafter appended claims.

What is claimed:

1. In a multi-cellular or pleated fabric shade apparatus employing a fabric having at least two margins, a means for deployment comprising a pair of sill mountable rails, said rails hingably connected by a dual hinge and hinge plate means having a first hinge and a second hinge whereby a first rail of said pair of rails, having a margin of said fabric attached thereto, may be fixed to a frame member located in a periphery of an opening housing said shade apparatus, and the second rail of said pair of rails, having another margin of said fabric attached thereto, may be radially translated away from said first rail deploying said fabric as it pivots about said dual hinge and hinge plate means and whereby deployment of the shade from a compressed position to an extended position causes said first hinge to travel in an arcuate path relative to said second hinge.

2. The invention of claim 1 wherein said first and second hinges are located at opposite ends of and are connected by a hinge plate.

3. The invention of claim 2 further comprising a single cord for moving said second rail of said pair of rails relative to said first rail of said pair of rails, said cord having one end fixedly secured to an end of said second rail that is spaced from said hinge and hinge plate means, said cord having a portion that slidably engages said first rail and said cord having another end that is graspable by a user whereby said shade can be retracted by a user applying force to said graspable end of said cord.

4. In a multi-cellular or pleated fabric shade apparatus, improved means for deployment comprising: a sill mountable rail adapted for attachment of a pleated or multi-cellular fabric thereto; a cord; and cord guidance means, said guidance means capable of being fixedly mounted on a perimeter of an opening into which the shade apparatus will be located and said guidance means mounting being spaced apart from said sill mountable rail whereby a portion of said cord is fixedly mounted to said shade at a single point and said cord can be slidably attached to said guidance means and to said sill mountable rail whereby movement of said cord in a first direction causes a portion of said fabric to move towards said guidance means and movement of said cord in a second direction causes said portion of said fabric to move towards said sill mountable rail.

5. The invention of claim 4 wherein said rail is at least partially hollow.

6. The invention of claim 5 further comprising a spring tensioner means disposed within said hollow portion of said rail, said tensioner means being operatively connected to said rail and having therein cord retention means through which a portion of said cord freely passes and is thereby placed under tension.

7. The invention of claim 6 wherein said cord is disposed so that it passes through said guidance means thence orthogonally passes to and into said rail via an entry point and is directed to said retention means of said tensioner means, and then exits said rail proximate and orthogonal to said entry point and passes back to said guidance means, thereby comprising a continuous cord loop.

8. The invention of claim 7 wherein said retention means is a ring mounted to said tensioner means and said cord passes unrestrictedly therethrough, and is subjected to constant tension by said tensioner means.

* * * * *

UNITED STATES PATENT AND TRADEMARK OFFICE

CERTIFICATE OF CORRECTION

PATENT NO. : 4,934,436

DATED : June 19, 1990

INVENTOR(S) : John T. Schnebly

It is certified that error appears in the above-identified patent and that said Letters Patent is hereby corrected as shown below:

At column 7, line 2, "fixed to (by conventional means) and" has been cancelled.

At column 7, line 23, following "fabric 14," --fixed to (by conventional means) and-- has been inserted.

Signed and Sealed this

Second Day of July, 1991

*Attest:*

*Attesting Officer*

HARRY F. MANBECK, JR.

*Commissioner of Patents and Trademarks*